US006210201B1

(12) United States Patent
Villain

(10) Patent No.: US 6,210,201 B1
(45) Date of Patent: Apr. 3, 2001

(54) INSERTION CONNECTION ASSEMBLY

(75) Inventor: Jean-Christophe Villain, Paris (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/329,205

(22) Filed: Jun. 10, 1999

(30) Foreign Application Priority Data

Sep. 7, 1998 (FR) ..... 98 08831

(51) Int. Cl.[7] ..... H01R 13/267
(52) U.S. Cl. ..... 439/357; 439/354
(58) Field of Search ..... 439/357, 660, 439/326, 354, 350, 218, 289, 341, 342

(56) References Cited

U.S. PATENT DOCUMENTS

| | | | | |
|---|---|---|---|---|
| 923,327 | | 1/1909 | Burton . | |
| 2,486,195 | | 11/1949 | Munsey | 173/328 |
| 5,044,977 | * | 9/1991 | Vindigni | 439/374 |
| 5,052,943 | | 10/1991 | Davis | 439/357 |
| 5,234,353 | | 8/1993 | Scholz et al. | 439/289 |
| 5,338,231 | | 8/1994 | Wilhite | 439/660 |
| 5,415,570 | * | 5/1995 | Sarkissian | 439/676 |
| 5,554,042 | * | 9/1996 | Denninger | 439/272 |
| 5,718,596 | | 2/1998 | Inaba et al. | 439/352 |
| 5,879,199 | * | 3/1999 | Belopolsky | 439/701 |
| 5,904,597 | | 5/1999 | Doi et al. | 439/660 |
| 5,993,231 | | 11/1999 | Hoolhorst | 439/218 |
| 6,048,228 | | 4/2000 | Aso | 439/660 |

FOREIGN PATENT DOCUMENTS

| | | |
|---|---|---|
| 678 777 A5 | 10/1991 | (CH) . |
| 196 11 423 C1 | 5/1997 | (DE) . |
| 0 591 723 A2 | 4/1994 | (EP) . |
| 0 701 303 A2 | 3/1996 | (EP) . |
| WO 96/28865 | 9/1996 | (WO) . |
| WO 97/36350 | 10/1997 | (WO) . |

* cited by examiner

*Primary Examiner*—Gary F. Paumen
*Assistant Examiner*—Alexander Gilman
(74) *Attorney, Agent, or Firm*—Sughrue, Mion, Zinn, Macpeak & Seas, PLLC

(57) ABSTRACT

In an insertion connection assembly, a wall of a cavity of a socket which receives a plug to be inserted is provided with a tongue. The tongue is designed to lock resiliently in a plane notch on the plug. By making such provision, the sides of the connector are left free to form guides for inserting the plug.

14 Claims, 4 Drawing Sheets

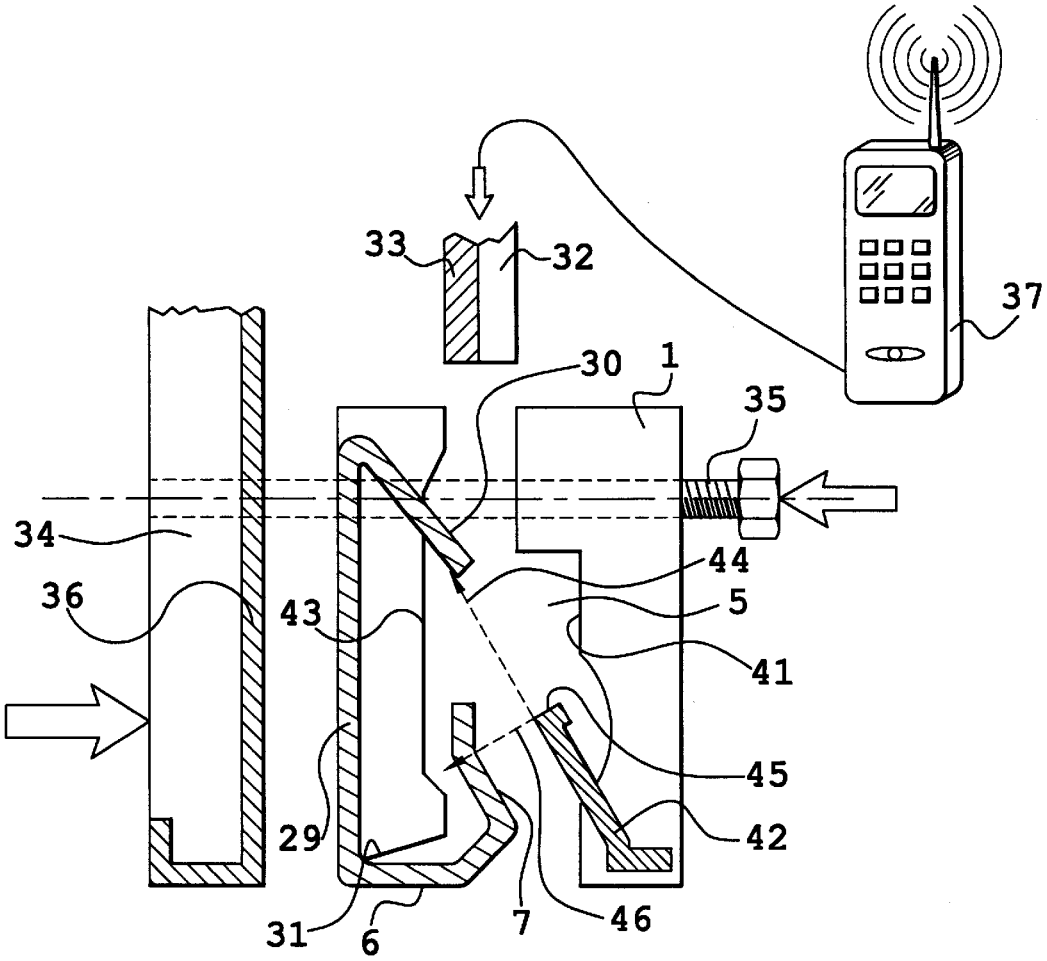
Fig. 1b
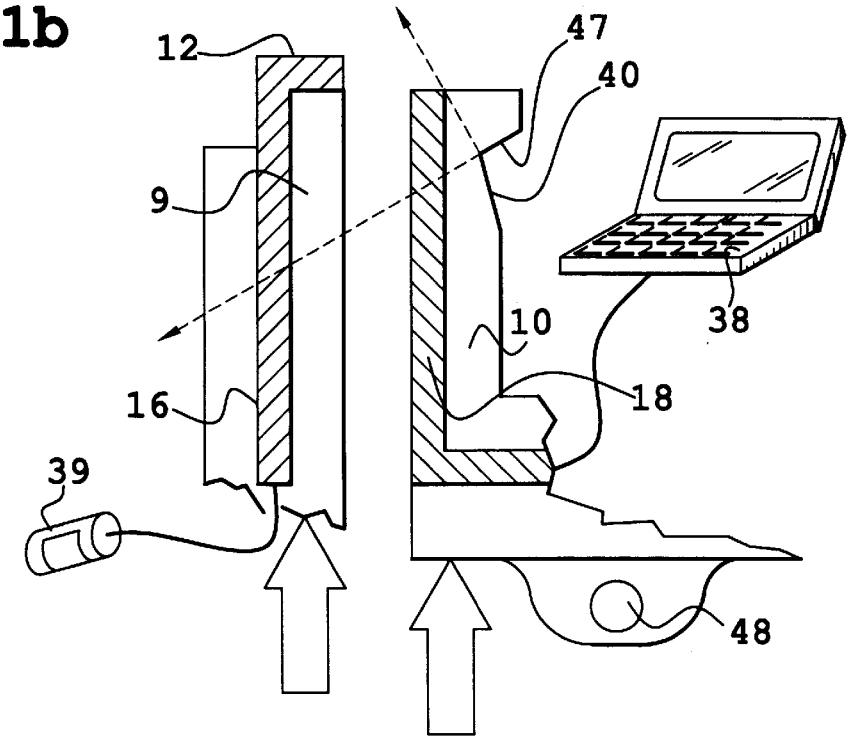

INSERTION CONNECTION ASSEMBLY

The present invention relates to an insertion connection assembly for mobile equipment, in particular for a mobile telephone set. The mobile telephone set may thus be a handset for use both in a GSM context and also domestically. More generally, the invention relates to any equipment that needs to be simple to connect at will, e.g. any equipment that is put back on a stand in order to recharge its battery.

BACKGROUND OF THE INVENTION

An object of the invention is to solve a problem that arises in insertion connection assemblies. In the field of connectors, there are two families. A first family comprises insertion connectors, and the second family comprises pressure connectors. In both cases, a plug and a socket of an outlet must be brought together. The plug and the outlet have terminations for establishing contact, and electrical cables connected to said terminations. In the pressure connection mode, the contact between conductive portions (normally metal portions) of the plug and corresponding conductive portions of the socket serves to limit the extent to which the socket and the plug can be brought together. The conductive portions of the two parts are brought together "head on", i.e. they are disposed on the "front" ends of said parts in the direction in which they are brought together.

In the insertion contact mode, the plug must be inserted into a cavity in the socket, the contact between the conductive zones of the plug and of the socket generally being established by sliding. The contact force is then lateral, i.e. it acts perpendicularly to the direction in which the plug and the socket are brought together. In the insertion connection mode, the metal portions can be subjected to wear as a result of them sliding against one another. To avoid such wear, "press-down" connectors may be provided. In such connectors, the plug advancing into the socket causes the conductive zones of the socket to move perpendicularly so that, at the end of the stroke, they come into contact with the metal zones on the plug. Pressure connection assemblies may be considered to be press-down devices whose angle of approach is large.

Pressure connectors are ill-suited to use in outlets but they are very useful for chargers and kits for vehicles. Insertion connectors are ill-suited to use in chargers and kits for vehicles, but they are well suited to use in outlets.

It is also known that it is possible to manufacture combined connectors, i.e. connectors whose sockets are suitable for receiving either pressure contact plugs or insertion contact plugs. In this field, PCT Patent Application WO-A-97/36350 describes a connector that can be used in two manners. In a connector of that type, the metal pressure-connection zones may be extended electrically into metal insertion-connection zones. To hold and guide the plugs in that socket, guide studs are provided on either side of a row of metal zones, which studs engage in or are locked in cavities.

The development in the use of electrical equipment, in particular in the field of telephony, has led to research into sockets having a variety of functions. For example, consideration has been given to a socket to be installed in a vehicle. In which case, the socket may serve to receive a mobile telephone in order to recharge the battery of the mobile telephone while it rests in the socket. In addition, in the same use, consideration has been given to cause the fact of placing the mobile telephone in the socket to switch over the audio channels (the loudspeaker and the microphone) either to a headset that may be worn by the driver of the vehicle, or to a loudspeaker-phone set installed in the vehicle facing the driver, so as to enable the driver to use the telephone in hands-free mode. Similarly, consideration has been given to connecting a buzzer for the driver, the buzzer replacing audible ringing for the purpose of alerting the wearer of the buzzer that the mobile telephone is receiving a call. Consideration has also been given to using the socket to relay transmission of messages forwarded by the mobile telephone. Such relaying is performed, for example, via a radio link at domestic frequency (e.g. 27 MHz). Finally, for data transmission, and in particular for facsimile transmission, provision is made to connect a microcomputer to the socket which is itself connected to the mobile telephone so as to use said mobile telephone as means for transmitting digital data. As has been observed, mobile telephone connection needs can be very varied. In addition, it has become necessary to organize simultaneous use of links of different types. In which case, the presence of side guide studs is inconvenient.

OBJECTS AND SUMMARY OF THE INVENTION

The invention solves that problem and, at the same time, can take advantage of the existence of combined pressure-and-insertion connectors to enable at least two connections to be made simultaneously from the socket to two different items of equipment. In the invention, it is possible to connect both a pressure plug and an insertion plug to the socket simultaneously. In which case, in preferred manner only the insertion connection is really locked, while the pressure connection remains free. As a result, rather than placing the lock of the pressure connection assembly on the sides of the connector, it is placed on the top thereof. It is shown below that it is thus possible to place other connectors on the sides, thereby increasing options for connecting different items of equipment.

The invention provides an insertion connection assembly, in particular for a mobile telephone, the assembly comprising a socket provided with a cavity, a contact flank of the cavity receiving a set of first metal zones juxtaposed across a ridge transversely to an insertion direction, and a plug provided with second metal zones on a contact face, provision being made for the first metal zones to come into contact with the second metal zones by the plug being inserted into the socket, wherein a retaining flank of the cavity, which flank is opposite the contact flank, and a retaining face of the plug, which face is opposite from the contact face, are provided with a resilient mechanism for engagement perpendicular to the retaining flank and to the retaining face.

BRIEF DESCRIPTION OF THE DRAWINGS

The invention will be better understood on reading the following description with reference to the accompanying figures which are given merely by way of non-limiting example, and in which:

FIGS. 1*a* to 1*c* are views in perspective and in section showing a combined connection assembly of the invention.

MORE DETAILED DESCRIPTION

Figure 1A:
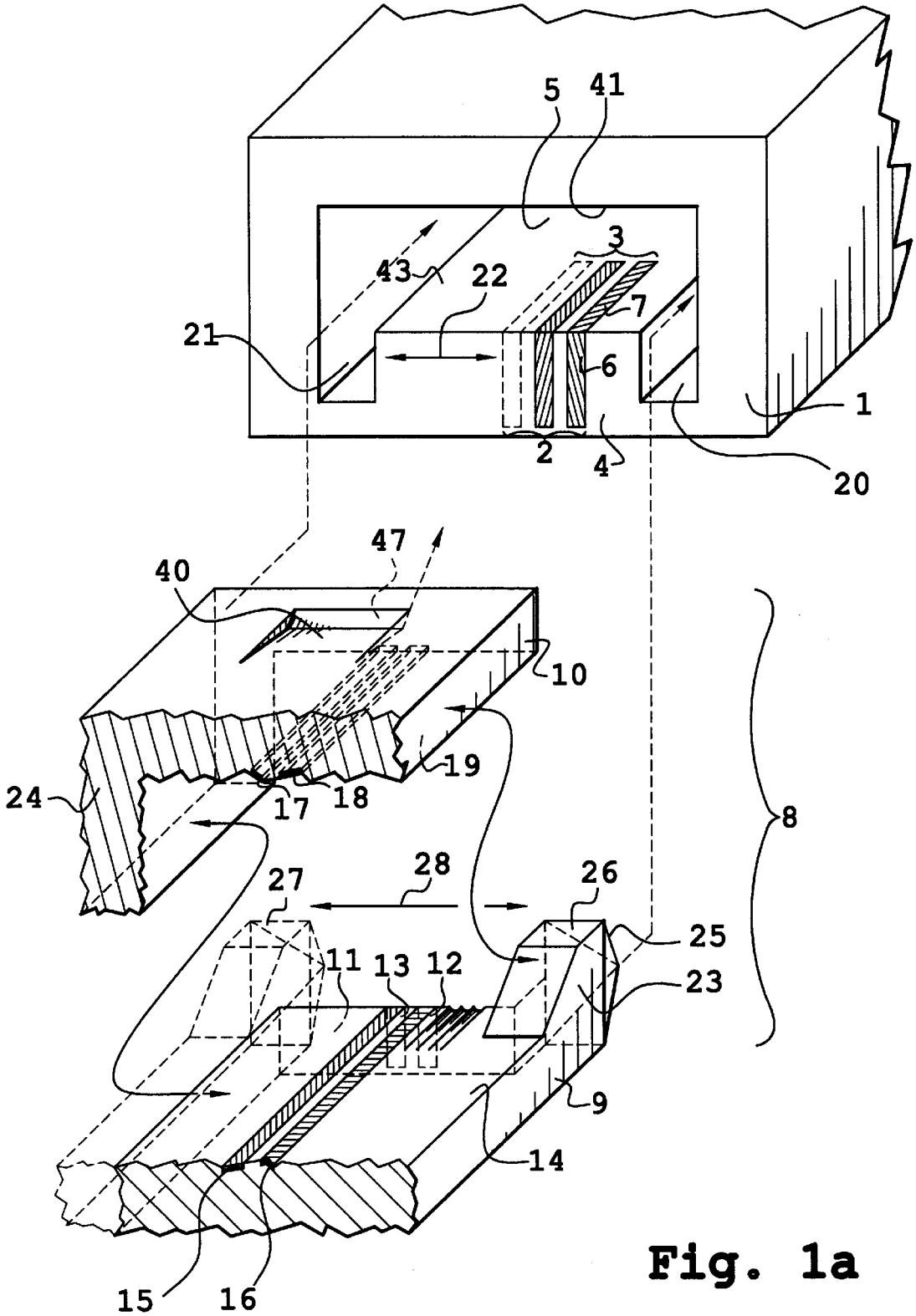

FIG. 1*a* is a perspective view of a combined connection assembly for a mobile terminal, in particular a mobile telephone terminal. The connection assembly includes a socket 1 provided with a set 2 of front metal zones. The socket 1 is also provided with a set 3 of lateral metal zones. The front metal zones are designed to serve to enable pressure contact to be established by engaging a plug against a front 4 of the socket 1. The metal zones of the set 3 serve to establish insertion contact with corresponding metal zones on a plug engaged in a cavity 5 in the socket 1. In the preferred example shown, and for a combined connection assembly, the front metal zones 6 of the set 2 and the lateral metal zones 7 of the set 3 may be connected respectively to one another. They are also connected to items of equipment (not shown in FIG. 1*a*) as explained below.

The connection assembly also includes a set 8 of plugs which, in a preferred embodiment, are complementary. A first plug 9 is designed to enter into pressure contact with the metal zones 6 of the set 2. A second plug 10 is designed to enter into insertion contact with the metal zones 7 of the set 3. For the purposes of complementarity, the plug 9 is substantially rectangular block shaped with a front edge 11 on which flush metal zones such as 12 and 13 of a set of metal zones corresponding to the set 2 are disposed. The metal zones 12 and 13 may, in practice, be implemented in the form of blades. These blades are extended over a top face 14 of the rectangular block of the plug 9. The plug 9 may be rigid, with extensions 15 and 16 to the front metal zone 12 ad 13 being brought into a flexible cable which is itself connected to equipment using this connection mode. The cable may be terminated at its other end by a connector that is preferably of the insertion type and that can be connected to the equipment (e.g. a mobile telephone). The extensions 15 and 16 may be placed at the bottoms of channels provided in the face 14 so that they are electrically isolated from any metal object placed on the face 14.

The plug 10 is provided with metal or conductive zones 17, 18 designed to come into sliding contact with the metal zones 7 of the set 3. For this purpose, the plug 10 also has a rigid end which engages in the cavity 5. The rigid end is connected to a flexible cable which extends the metal zones 17 and 18 to another item of equipment (e.g. a microcomputer). For example, the metal zones 17 and 18 are connected to the metal zones 7 by implementing the metal zones in the form of flexible metal blades which push against one another on insertion.

The plugs 9 and 10 are preferably of complementary shapes. Thus, the plug 10 has a contact face 19 designed to be placed with or without electrical contact above the face 14. The complementarity also concerns the existence of two pieces of relief relative to a surface defined by the faces 14 and 19. The pieces of relief may project from or else be set back from the front face (i.e. in the cavity) of the socket 1. In the example shown, the socket 1 thus a has two grooves 20 and 21 set back from its front face and situated on either side of a ridge 22 across which the sets 2 and 3 of metal zones extend transversely. Corresponding to the grooves 20 and 21, the plugs 9 and 10 are respectively provided with a border 23 and with a border 24. When the plug 9 is placed against the socket 1, the border 23 engages in the groove 20 placed on the right of the ridge 22. For this purpose, the engagement end of the border 23 is provided with a conical portion 25 facilitating engagement, and with a slide portion 26 guiding the border in the groove 20. The border 24 is provided with corresponding means. For the border 24, the slide portion may be longer so as to take advantage of the insertion length.

It is possible to use the plug 9 on its own, and to provide it symmetrically with a border 27 of the same type as the border 23. In which case, the complementarity between the plugs 9 and 10 is obtained by sliding the plug 10 in a recess provided between the two borders 23 and 27. It is also possible to provide other forms of complementarity. In particular, instead of being provided with insertion grooves 20 and 21, the cavity 5 may be provided with other profiles. The other profiles must make it possible at least for each of the two plugs to be brought correctly onto the socket 1, it being possible for the other plug to make use of the existence of relief or grooves provided in the first plug to be received in register in the socket 1. In all cases, one plug may be in contact with the socket without the other plug being in contact therewith.

A shown, the socket 1 thus co-operates with two complementary plugs by them being superposed for connection purposes. It is possible, in the transverse direction of the ridge 22, to provide other connection assemblies, each of which comprises a socket 1 provided with sets 2 and 3 of associated connections, and serving to co-operate with corresponding plugs. In one example, a triple socket 1 was formed with a set 2–3 of metal zones having eight contacts for data transmission purposes (for an eight-wire bus), a set 2–3 of three contacts for electrically charging the mobile equipment, and a set 2–3 of eight contacts also for diverting all of the audio functions, and for accommodating the existence of a buzzer, or a headset etc. The three sets are disposed side-by-side. Optionally, a groove 20 or 21 may be common to two sets.

FIG. 1*b* shows the preferred configuration in which the plugs 9 and 10 are mounted in the socket 1. The socket 1 is thus provided with blades 29 for forming the metal zones 6 and 7 held in a molded structure constituting the socket 1. Each of the blades 29 has a front portion 6 on the front of the socket 1, and a lateral portion 7 extending inside the cavity 5. In a preferred embodiment, each of the blades 29 also has a rear portion 30 which also penetrates into the cavity 5. The portion 6 of the blade 29 serves to co-operate electrically by coming into contact with a contact front face 12 of a connection 16 of the plug 9. The portion 7 of the blade 29 serves to co-operate electrically with a metal zone 18 of the plug 10. The blade 29 thus has a front-and-lateral portion 6–7 capable of resiliently moving about an axis of rotation 31. As explained below, this resilient movement contributes both to holding the pressure plug 9 properly and to keeping the insertion plug 10 properly in contact.

Via the rear of the cavity 5, it is also possible to cause another insertion plug 32 to penetrate into the socket 1, which plug is provided with lateral conductive zones 33 serving to come into contact with the extensions 30. If necessary, the socket 1 may be fastened against a structure 34 by screws 35.

In the example shown in FIG. 1*b*, the pressure plug 9 is connected to an office charger, or a vehicle kit including a plug 39 for connection to a cigarette lighter of a vehicle. The plug 10 is connected to a microcomputer 38. The rear plug 32 is connected to a mobile telephone. As explained above, other sets of connections 2–3 may be provided in the transverse direction 22 for connecting a headset or a small domestic-frequency transceiver for forwarding messages from the mobile telephone in cordless manner. This is particularly useful for people who, since they do not have pockets in which to place mobile telephones, put them in bags and prefer to use headsets, which are much lighter in weight, in order to converse.

FIGS. 1*a* and 1*b* show a preferred embodiment of the locking means of the invention for locking the plug 10 in the cavity 5. For this purpose, the plug 10 (FIG. 1*a*) has a plane notch 40. In register with the notch 40, the socket 1 is provided with a retaining flank 41 provided with a resilient tongue 42. The retaining flank 41 faces a flank 43 inside the cavity 5, against which flank the metal zones 7 serving in the insertion connection mode are pressed. The tongue 42 has two slopes relative to the flank 41. A first slope 44 slopes gently relative to the retaining flank 41. This slope 44 serves to enable the front portion of the plug 10 to be engaged easily. On engaging the plug, one end of the tongue 42 is pushed back into a recess in the wall 41. At its end, the tongue 42 is provided with an abutment 45 which slopes much more steeply. The abutment 45 serves to come into abutment against a wall 47 of the notch 40. The slope 46 is steep in order to constitute effective locking to prevent the plug 10 from being withdrawn too naturally. The slope 46 is not perpendicular to the face 45 so that it is nevertheless possible to withdraw the plug by exerting a sufficient traction force on the plug 10. For this purpose, it may be provided with an extraction ring 48. The notch 40 is provided with a triangular profile complementary to the slopes 44 and 46. Naturally, it is possible to invert the presence of the notch 40 and of the tongue 42 in the plug and in the wall 41. The solution shown is however preferred because only the socket 1 in this example need be provided with the various tongues 29 and 42. This simplifies manufacture if these tongues are all made of metal. The tongue 42 may also be made of plastic. The socket 1 and the plugs 9 and 10 may be obtained by entirely conventional molding.

Figure 1C:
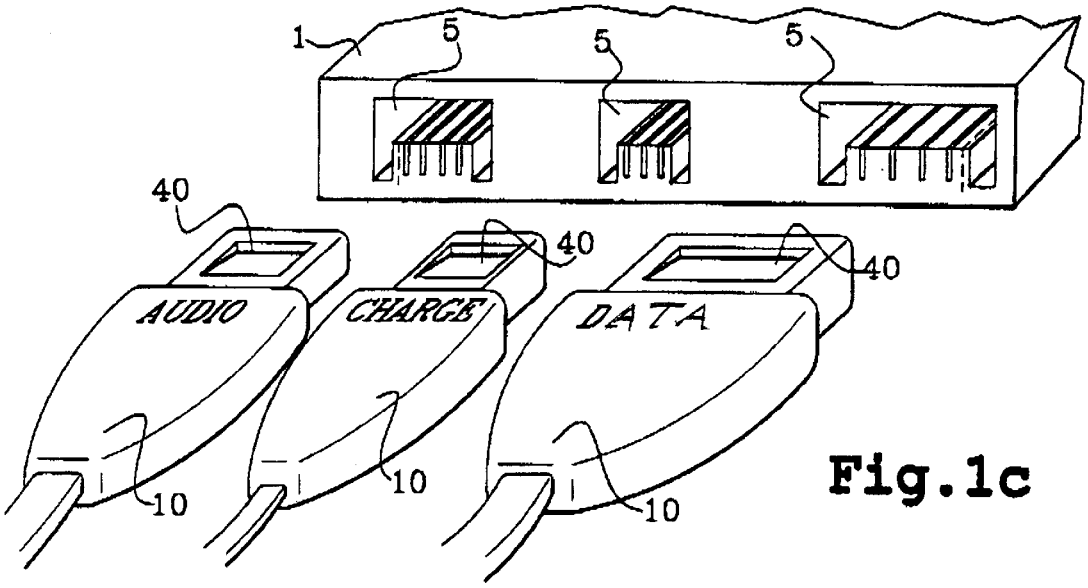

FIG. 1*c* shows how three insertion plugs 10 with plane notches 40 may be juxtaposed. The three plugs simultaneously inserted in the socket 1 respectively serve for audio purposes, for charging purposes, and for data transfer purposes. The audio connector and the data transfer connector preferably have eight electrical contacts each. The presence of the notches 40 in the top faces makes such juxtaposition possible. The socket 1 is then provided with three juxtaposed cavities 5 in a transverse direction 22 in which the sets of metal zones extend, so that each cavity receives a respective one of the three plugs.

Figure 2A:
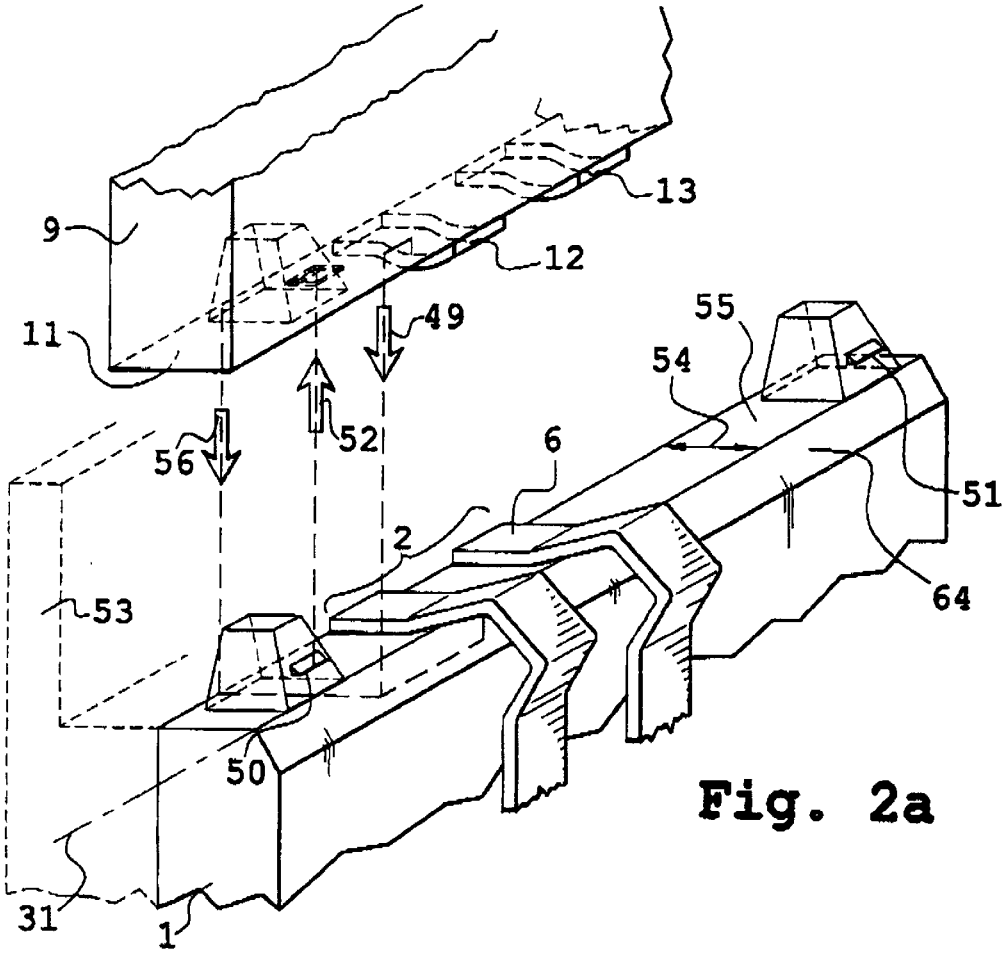
FIGS. 2*a* to 2*c* are views in perspective and in section of an improvement showing a preferred implementation of the pressure contact mode.

FIG. 2*a* is a perspective view of a preferred implementation of pressure connection. In this case, a plug 9 comes into position above the front blades 6 of the set 2. The plug 9 is provided with corresponding blades 12–13 on a front edge 11, which blades come into pressure contact with the blades of the set 2. According to an important characteristic, by co-operating mechanically with the blades of the set 2, the blades 12 and 13 generate a reaction force 49 tending to push the plug 9 upwards.

The socket 1 is further provided with a set of catches 50 and 51 serving to catch inside cavities provided in the edge 11. The catches 50–51 are shown as projecting above the front face 55 of the socket 1, but it is quite possible optionally to invert the mechanism and to provide the catches 50 in the conical projections 25 of the borders 26 and 27 (see FIG. 1*a*). By doing this, the catches 50 tend to attract the plug towards the socket 1 in the direction referenced 52 by means of a resilient configuration explained below. In the invention, the forces 49 and 52 thus generated form overturn torque tending to overturn the plug 9 (or the mobile telephone whose bottom end is equipped with such a plug).

This overturn torque is resisted either by the existence of a back 53 secured to the socket 1 or by the thickness 54 of the front 55 of the socket 1. The corresponding reaction force 56 works in the same direction as the force 49.

Under these conditions, the pressure contact between the blades 12 & 13 and the metal zones 6 is much better. In the preferred example, a mobile telephone must be as light in weight as possible. If its weight alone is used to establish the pressure contact with the blades of the set 2, the pressure is insufficient. In particular when the set 2 comprises about ten contacts, and when the mobile telephone weighs about 100 grams, the pressure forces on each blade are about 10 grams: they are very insufficient. In contrast, when the mobile telephone is placed in abutment against the face 55 in accordance with the invention, the operator has no difficulty in pressing for a short time with a non-negligible force, e.g. about 5 kg. In which case, the operator forces the catches 50 and 51 to engage in the corresponding cavities. It is possible to choose the resilient forces of the catches 50 and 51 so that each of them exerts a retaining force of about 1 kg. As a result, a force of 2 kg is then available for being distributed over about ten contacts: i.e. 200 grams per contact, which is quite sufficient.

Figure 2B:
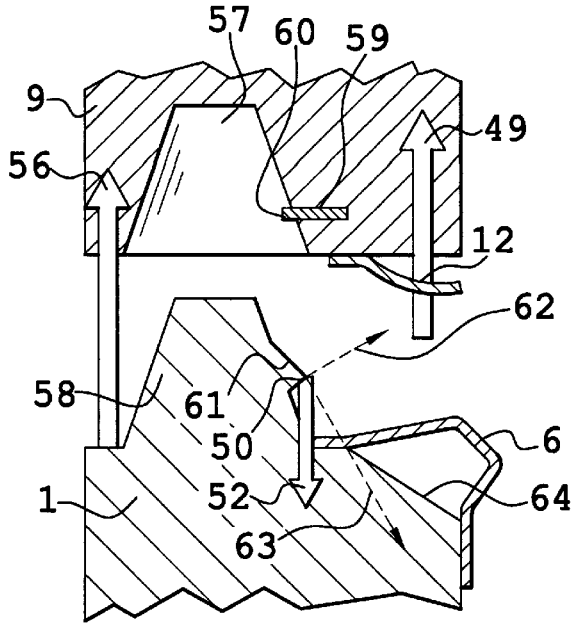

FIG. 2*b* is a diagrammatic section view showing how the catches 50 and 51 co-operate. Cavities 57 are provided in the edge 11 of the plug 9 facing studs 58 carried by the socket 1 (or the reverse configuration is used). The studs 58 are provided with the catches 50. The cavities are provided with catching tongues 59. The catching tongues 59 can be provided at the time of manufacture by molding of the plug 9. The tongues 59 project inside the cavity 57 and they are held in the structure of the plug 9. For example, they may be held by molding. Each of the tongues 59 is provided with an end 60 serving to co-operate with a tip 61 of a catch 50. On insertion, it is necessary to force (e.g. with a force of 5 kg) on the plug 9 or on the mobile telephone to engage it and to cause the end 60 of the tongue to go beyond the tip 61. For disengagement, either the socket is heavy enough, or it is fixed to a non-removable portion (dashboard of the vehicle), or else the operator uses both hands to disengage the two parts. The tip 61 is thus provided with two slopes 62 and 63 relative to the end 60, the inclination of the slopes being chosen as a function of the desired ease and difficulty of insertion and of removal.

By acting in this manner, the forces 49 and 52 balance out. The intermediate position of the force 52 between the forces 49 and 56 should be noted. Dashed lines show the distribution of the forces. In order to enable the stresses to be balanced out in this way, the front face 55 of the socket 1 is provided with a sloping surface 64 which can accommodate a tongue 6 on insertion if the engagement direction is not exactly perpendicular to the face 55. The sloping surface 64 in particular facilitates putting the plug 9 in place in the socket 1 by effecting a slight rotation. This rotation associated with the special shape of the studs 58 makes it possible to insert the plug 9 into the socket 1 and to extract it therefrom without any effort.

Figure 2C:
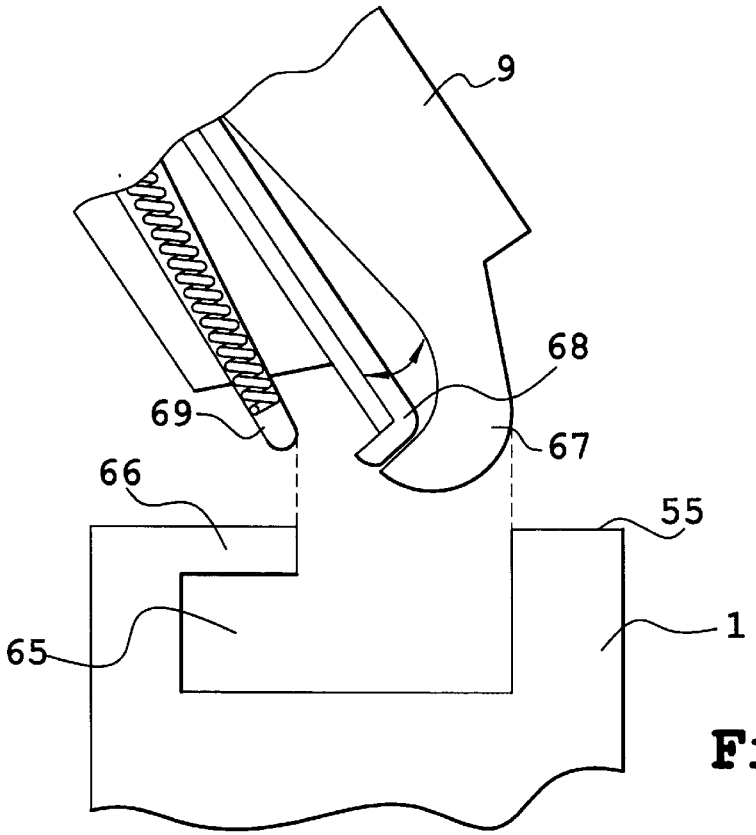

FIG. 2*c* shows a variant of the catches. The edge 55 of the socket 1 is provided with a cavity 65 provided with an overhang 66. The plug 9 is provided with a catch 67 provided with a resilient hook 68. For engagement, the catch 67 of the plug 9 is lowered into the cavity 65. Then the plug 9 is righted. Such righting is made easier by the presence of telescopic electrical contacts 69 which come into abutment in alignment above the overhang 66.

I claim:

1. An insertion connection assembly, in particular for mobile telephone, the assembly comprising a socket provided with a cavity, a contact flank of the cavity receiving a set of first metal zones juxtaposed across a ridge transversely to an insertion direction of said cavity such that said first metal zones extend from a front end of an opening of said cavity inwardly into said cavity in the insertion direction of said cavity, and a plug provided with second metal zones on a contact face, provision being made for the first metal zones to come into contact with the second metal zones by the plug being inserted into the socket, wherein a retaining flank of the cavity, which flank is opposite the contact flank, and a retaining face of the plug, which face is opposite from the contact face, are provided with a resilient mechanism for engagement perpendicular to the retaining flank and to the retaining face; and wherein portions of said first metal zones at the front of end of the opening of said cavity define a set of pressure metal zones in the socket, and portions of said first metal zones disposed inwardly into said cavity in the insertion direction of said cavity define a set of insertion metal zones, and wherein said plug further comprises an insertion contact plug and a pressure contact plug each provided with metal zones to make it possible to establish insertion connection between said insertion contact plug and said set of insertion metal zones and pressure connection between said pressure contact plug and said set of pressure metal zones simultaneously.

2. An assembly according to claim 1, wherein, in the mechanism, the retaining flank is provided with a catch in relief, the retaining face being provided with a notch for receiving the catch in relief.

3. An assembly according to claim 2, wherein the catch is provided with a resilient metal blade projecting from the flank with two opposite slopes, an insertion slope sloping less steeply on the flank than the disengagement slope.

4. An assembly according to claim 1, including a socket provided with three juxtaposed cavities for receiving three plugs simultaneously.

5. An insertion connection assembly, comprising:

a socket having a cavity and a contact flank, said contact flank of said cavity including a first metal zone disposed at a front end of an opening of said cavity and extending inwardly into said cavity in an insertion direction of said cavity;

a pressure contact plug having a second metal zone disposed on a front face of said contact plug so as to make head on contact with said first metal zone at the front end of said opening of said cavity when said pressure contact plug is connected to said socket; and an insertion plug having a third metal zone disposed on a contact face of said insertion plug so as to make sliding contact between said first metal zone where said first metal zone extends inwardly into said cavity when said insertion plug is connected to said socket;

wherein said pressure contact plug and said insertion plug are adapted to be simultaneously connected to said socket so as to make contact with said first metal zone; and wherein said cavity further comprises a retaining flank disposed opposite said contact flank; and wherein said insertion plug further comprises a retaining face disposed opposite said contact face; and wherein said insertion connection assembly further comprises a resilient mechanism on one of said retaining flank and said retaining face for engagement with said other of said retaining flank and said retaining face.

6. The insertion connection assembly according to claim 5, wherein said resilient mechanism on one of said retaining flank and said retaining face is adapted for engagement perpendicular to said other of said retaining flank and said retaining face in a direction transverse to the insertion direction of said cavity.

7. The insertion connection assembly according to claim 6, wherein said resilient mechanism is structured such that said retaining flank is provided with catch in relief, and said retaining face is provided with a notch for receiving said catch in relief.

8. The insertion connection assembly according to claim 7, wherein said catch is provided with a resilient metal blade projecting from said retaining flank and having an insertion slope and a disengagement slope such that the insertion slope is less steep with respect to said retaining flank than said disengagement slope.

9. The insertion connection assembly according to claim 5, wherein said socket includes a plurality of juxtaposed cavities for simultaneously receiving a corresponding plurality of separate sets of plugs, and wherein each set of plugs includes a pressure contact plug and an insertion plug.

10. The insertion connection assembly according to claim 5, wherein said socket and plugs are for a mobile telephone.

11. The insertion connection assembly according to claim 5, wherein said socket comprises a plurality of first metal zones juxtaposed adjacent to each other, and wherein said pressure contact plug and said insertion plug comprise a corresponding plurality of second and third metal zones respectively.

12. The insertion connection assembly according to claim 5, further comprising catching protrusions on one of said socket and said pressure contact plug, and corresponding catching protrusion cavities on the other of said socket and said pressure contact plug; said catching protrusions and protrusion cavities cooperating to secure said pressure contact plug to said socket upon being engaged.

13. An insertion connection assembly, comprising:

a socket having a cavity and a contact flank, said contact flank of said cavity including a first metal zone disposed at a front end of an opening of said cavity and extending inwardly into said cavity in an insertion direction of said cavity;

a pressure contact plug having a second metal zone disposed on a front face of said contact plug so as to make head on contact with said first metal zone at the front end of said opening of said cavity when said pressure contact plug is connected to said socket; and an insertion plug having a third metal zone disposed on a contact face of said insertion plug so as to make sliding contact between said first metal zone where said first metal zone extends inwardly into said cavity when said insertion plug is connected to said socket; and wherein said socket further comprises a rear opening, and wherein said first metal zone has an end which extends into said cavity near said rear opening, said insertion connection assembly further comprising a rear insertion plug having a fourth metal zone disposed on a contact face of said rear insertion plug so as to make sliding contact between said first metal zone where said first metal zone extends into said cavity near said rear opening when said insertion plug is connected to said socket.

14. An insertion connection assembly, comprising:

a socket having a cavity and a contact flank, said contact flank of said cavity including a first metal zone disposed at a front end of an opening of said cavity, and a second metal zone extending inwardly into said cavity in an insertion direction of said cavity;

a pressure contact plug having a third metal zone disposed on a front face of said contact plug so as to make head on contact with said first metal zone when said pressure contact plug is connected to said socket; and an insertion plug having a fourth metal zone disposed on a contact face of said insertion plug so as to make sliding contact between said second metal zone when said insertion plug is connected to said socket; and wherein said pressure contact plug and said insertion plug are adapted to be simultaneously connected to said socket so as to make electrical contact with said first metal zone and said second metal zone, respectively; and wherein said cavity further comprises a retaining flank disposed opposite said contact flank; and wherein said insertion plug further comprises a retaining face disposed opposite said contact face; and wherein said insertion connection assembly further comprises a resilient mechanism on one of said retaining flank and said retaining face for engagement with said other of said retaining flank and said retaining face.

* * * * *